US005484222A

United States Patent [19]

Schulze-Beckinghausen

[11] Patent Number: 5,484,222

[45] Date of Patent: Jan. 16, 1996

[54] APPARATUS FOR GRIPPING A PIPE

[75] Inventor: Joerg E. Schulze-Beckinghausen, Garbsen, Germany

[73] Assignee: Weatherford/Lamb, Inc., Houston, Tex.

[21] Appl. No.: 182,299

[22] Filed: Jan. 14, 1994

[30] Foreign Application Priority Data

Oct. 8, 1993 [GB] United Kingdom ..... 9320919

[51] Int. Cl.[6] ..... E21B 17/10

[52] U.S. Cl. ..... 403/307; 403/369; 403/370; 166/77.51; 166/78.1; 192/45; 269/199; 269/200; 269/232; 269/233; 269/234

[58] Field of Search ..... 403/307, 370, 403/369; 166/77.5, 78; 81/57.18, 57.33, 476; 269/199, 200, 232, 233, 234, 288, 900, 902; 192/45, 6 R, 6 B

[56] References Cited

U.S. PATENT DOCUMENTS

| | | | |
|---|---|---|---|
| 1,451,111 | 4/1923 | Reedy | 403/351 X |
| 1,512,675 | 10/1924 | Chryst | 192/45 |
| 2,061,151 | 11/1936 | Gunderman et al. | 138/96 T |
| 2,082,842 | 6/1937 | Marland | 192/45 |
| 2,305,637 | 12/1942 | Ricciardi | 81/476 |
| 2,757,523 | 8/1956 | Schmid | 81/476 X |
| 2,839,164 | 6/1958 | Rousselr | 188/67 |
| 3,019,680 | 2/1962 | Daugherty et al. | 81/57.18 |
| 3,049,382 | 8/1962 | Ell | 308/4 |
| 3,096,075 | 7/1963 | Brown | 188/67 X |
| 3,667,252 | 6/1972 | Nelson | 62/23.5 |
| 3,722,603 | 3/1973 | Brown | 81/57.18 X |
| 3,986,583 | 10/1976 | Kinzbach | 188/67 |
| 4,345,851 | 8/1982 | Soussloff | 403/369 |
| 4,630,690 | 12/1986 | Beasley et al. | 403/370 X |
| 4,697,830 | 10/1987 | Wood et al. | 285/27 |
| 4,726,703 | 2/1988 | Ashley | 403/370 |
| 4,973,186 | 11/1990 | Adolfsson | 403/370 X |
| 5,020,942 | 6/1991 | Pallini, Jr. | 403/369 X |
| 5,286,133 | 2/1994 | Wood | 403/370 X |

FOREIGN PATENT DOCUMENTS

| | | | |
|---|---|---|---|
| 934489 | 5/1948 | France | 269/199 |
| 2181683A | 4/1987 | United Kingdom . | |

*Primary Examiner*—Randolph A. Reese
*Assistant Examiner*—Christopher J. Novosad
*Attorney, Agent, or Firm*—Guy McClung

[57] ABSTRACT

An apparatus for gripping a pipe, which apparatus comprises an outer member having a first inclined inner surface, and an inner member having a first inclined outer surface, the arrangement being such that, in use, on rotation of said outer member relative to said inner member in one sense said first inclined inner surface co-operates with said first inclined outer surface so that said inner member moves towards a pipe to be gripped.

32 Claims, 5 Drawing Sheets

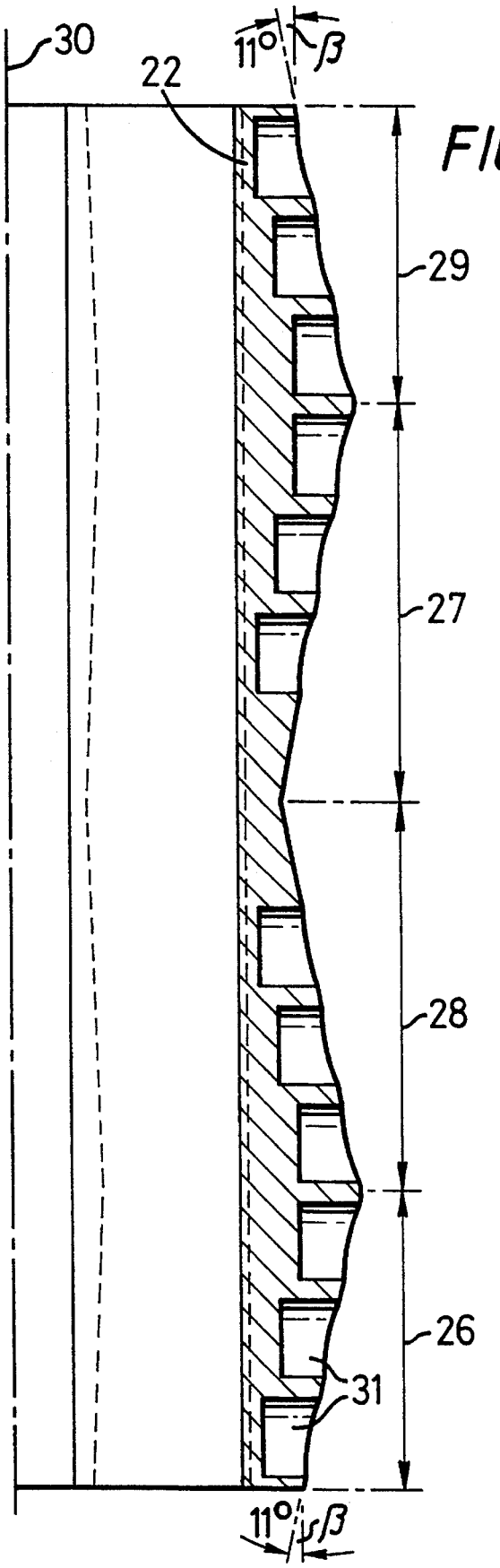
FIG. 5
FIG. 6
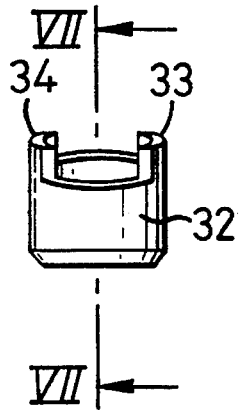
FIG. 7
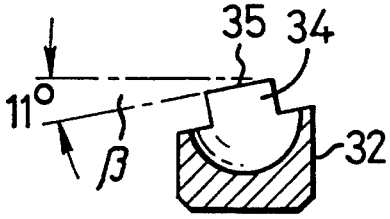

APPARATUS FOR GRIPPING A PIPE

FIELD OF THE INVENTION

This invention relates to an apparatus for gripping a pipe.

BACKGROUND OF THE INVENTION

The increasing use of pipes known as "premium tubulars" in the construction of oil and gas wells has made it desirable to develop jaws which do not or only minimally damage the surface of the tubulars. Such jaws, which are generally referred to as "non-marking jaws" usually comprise an elastomeric material the pipe gripping surface of which may be coated with fine abrasive material to improve the grip.

Various means are used for applying such jaws to a pipe. In one known arrangement a multiplicity of hydraulic cylinders are provided which, in use, surround the tubular to be gripped and apply a generally uniform pressure to the jaws.

Whilst this arrangement provides the necessary gripping force it is relatively expensive to manufacture, operate and maintain. Furthermore, it relies on a convenient supply of hydraulic fluid being available.

Various mechanical arrangements are known for applying conventional jaws to conventional tubulars. Essentially, these mechanical arrangements are designed to press teeth on the jaw into the conventional tubular to obtain the necessary grip. These mechanical arrangements are designed to provide substantial radial force over a small area and are not suitable for use with non-marking jaws which ideally require to be applied with a generally uniform radially inward pressure.

At least preferred embodiments of the present invention aim to achieve this objective.

SUMMARY OF THE PRESENT INVENTION

According to the present invention there is provided an apparatus for gripping a pipe, which apparatus comprises an outer member having a first inclined inner surface, and an inner member having a first inclined outer surface, the arrangement being such that, in use, on rotation of said outer member relative to said inner member in one sense said first inclined inner surface co-operates with said first inclined outer surface so that said inner member moves towards a pipe to be gripped.

Preferably, said outer member comprises a second inclined inner surface spaced from said first inclined inner surface and said inner member comprises a second inclined outer surface spaced from said first inclined outer surface.

Advantageously, said outer member comprises a first oppositely inclined inner surface, and said inner member comprises a first oppositely inclined outer surface, the arrangement being such that on rotation of said outer member relative to said inner member in the opposite sense said first oppositely inclined inner surface cooperates with said first oppositely inclined outer surface so that said inner member moves towards a pipe to be gripped.

Preferably, said outer member comprises a second oppositely inclined inner surface, and said inner member comprises a second oppositely inclined outer surface arranged to co-operate therewith.

It is particularly important with premium tubulars that the joints should be tightened to the correct torque and that the joint should not be loosened when the tong is reversed to release the jaws.

Preferably, the inclined surfaces are inclined at an angle such that the inner member and outer member do not lock against one another. Advantageously, the surfaces should be inclined at an angle of at least 7°, and preferably 11° to longitudinal axis of the pipe.

Advantageously, the inner member and the outer member are threadedly connected by a thread which, preferably is not self locking. Advantageously, the thread should be inclined at an angle of at least 7° and preferably 11° to a plane perpendicular to the pipe.

Preferably, the outer surface of the inner member is provided with at least one bearing, for example a ball bearing, and the inner surface of the outer member is provided with at least one groove for accommodating said bearing.

Advantageously, said apparatus includes at least two inner members.

Preferably, said outer member has a separate groove for each said inner member.

In a particularly preferred embodiment the apparatus has four inner members, wherein said outer member has four separate grooves.

Preferably, the or each inner member is provided with an elastomeric gripping member the surface of which is preferably provided with abrasive to enhance the gripping ability thereof.

Advantageously, said apparatus includes at least one spring to facilitate the release of said inner member after use.

Preferably, the inclined surfaces are conical. However, whilst this is much preferred it is not absolutely essential.

For a better understanding of the present invention reference will now be made, by way of example, to the accompanying drawings, in which:

BRIEF DESCRIPTION OF THE DRAWINGS

FIG. 5 shows, to a different enlarged scale, a section through an inner member forming part of the apparatus shown in FIG. 1;

FIG. 6 is a side elevation of a ball bearing holder for use in the inner member shown in FIG. 5; and FIG. 7 is a view on line VII—VII of FIG. 6.

DETAILED DESCRIPTION OF THE PREFERRED EMBODIMENT

Figure 1:
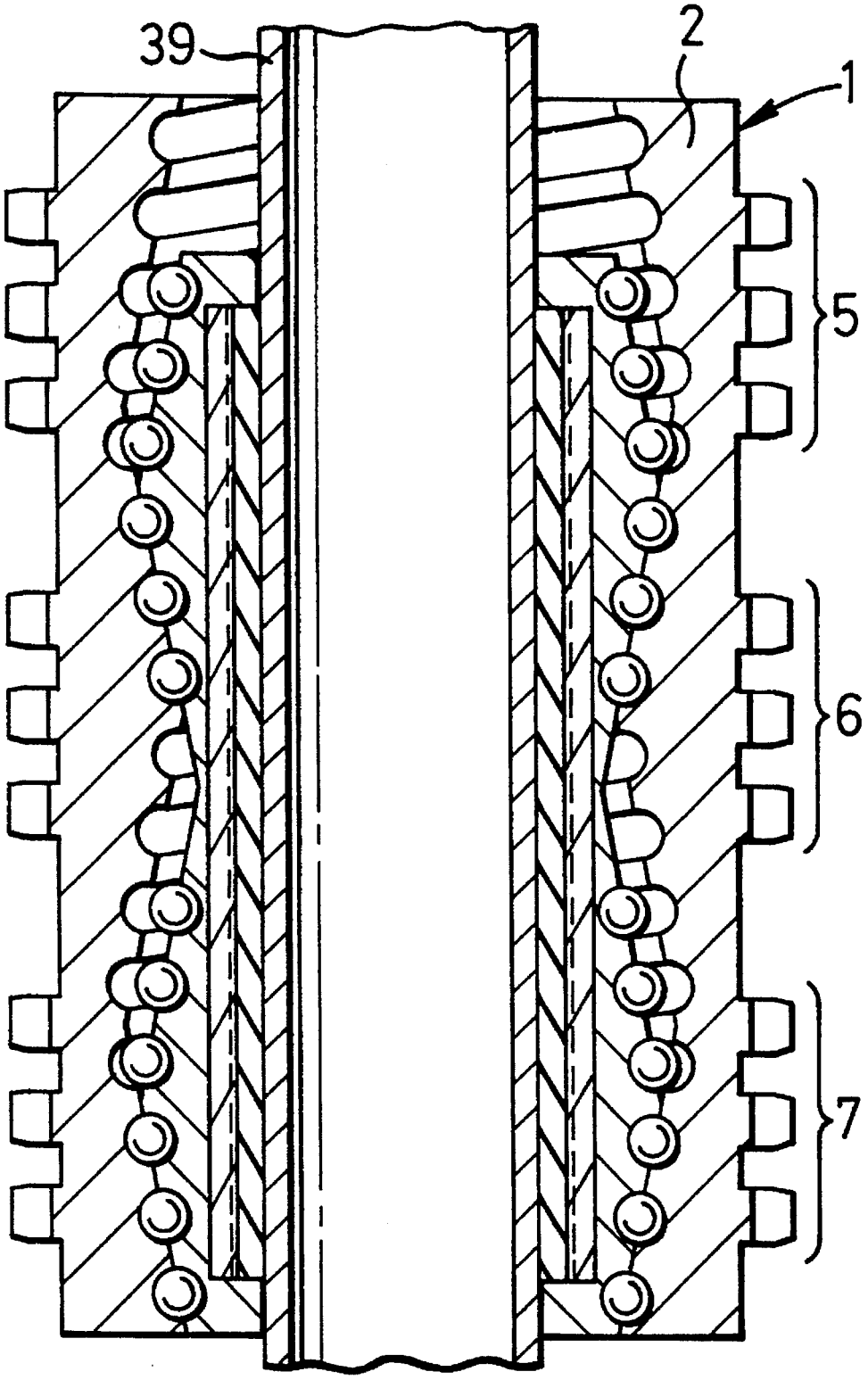
FIG. 1 is a vertical cross-section through one embodiment of an apparatus in accordance with the invention gripping a pipe for rotation in one sense.

Referring to FIG. 1 of the drawings there is shown an apparatus which is generally identified by reference numeral 1.

Figure 3:
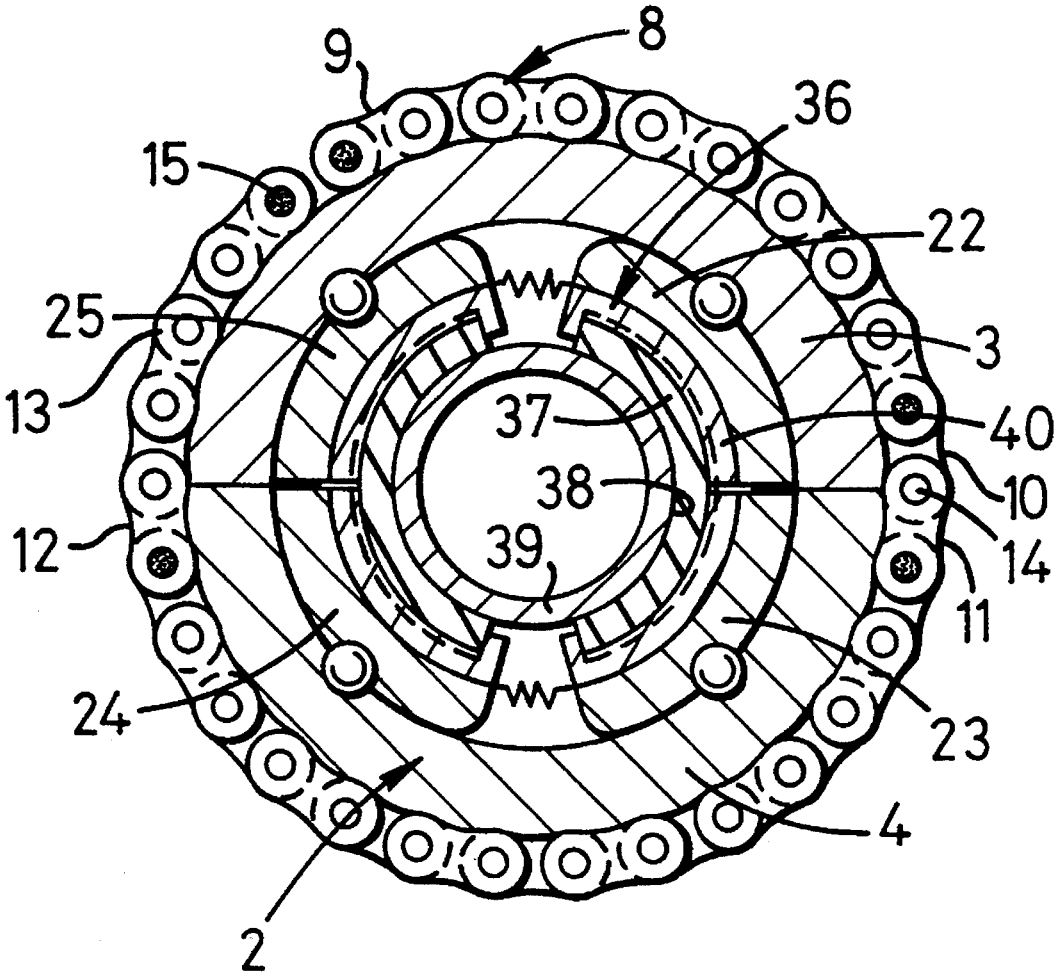
FIG. 3 is an underneath plan view of the apparatus shown in FIG. 1.

The apparatus 1 comprises an outer member 2 which, as shown in FIG. 3, comprises two halves 3 and 4 the outer circumference of which is provided with nine rows of teeth arranged in three groups 5, 6 and 7.

A chain is mounted on the lowermost row of teeth and is welded to the teeth at locations 9, 10, 11 and 12. The end section 13 of the chain 8 is movable so that when the end section 13 is lifted away from the teeth on half 3 the halves 3 and 4 can be pivoted opened and closed about an axis formed by the pin 14 of chain 8. When the halves 3 and 4 are closed they can be held together by placing the end section 13 of the chain 8 over the teeth on half 3 as shown.

Chains similar to chain 8 are associated with each of the nine rows of teeth and a rod 15 is provided which interconnects the free end of each end section so that all nine chains can be rapidly engaged and disengaged as required. If desired, retainers (not shown) may be provided as each end of the outer member 2 to prevent the end sections of the chains inadvertently being disengaged from the teeth on half 3.

Figure 4:
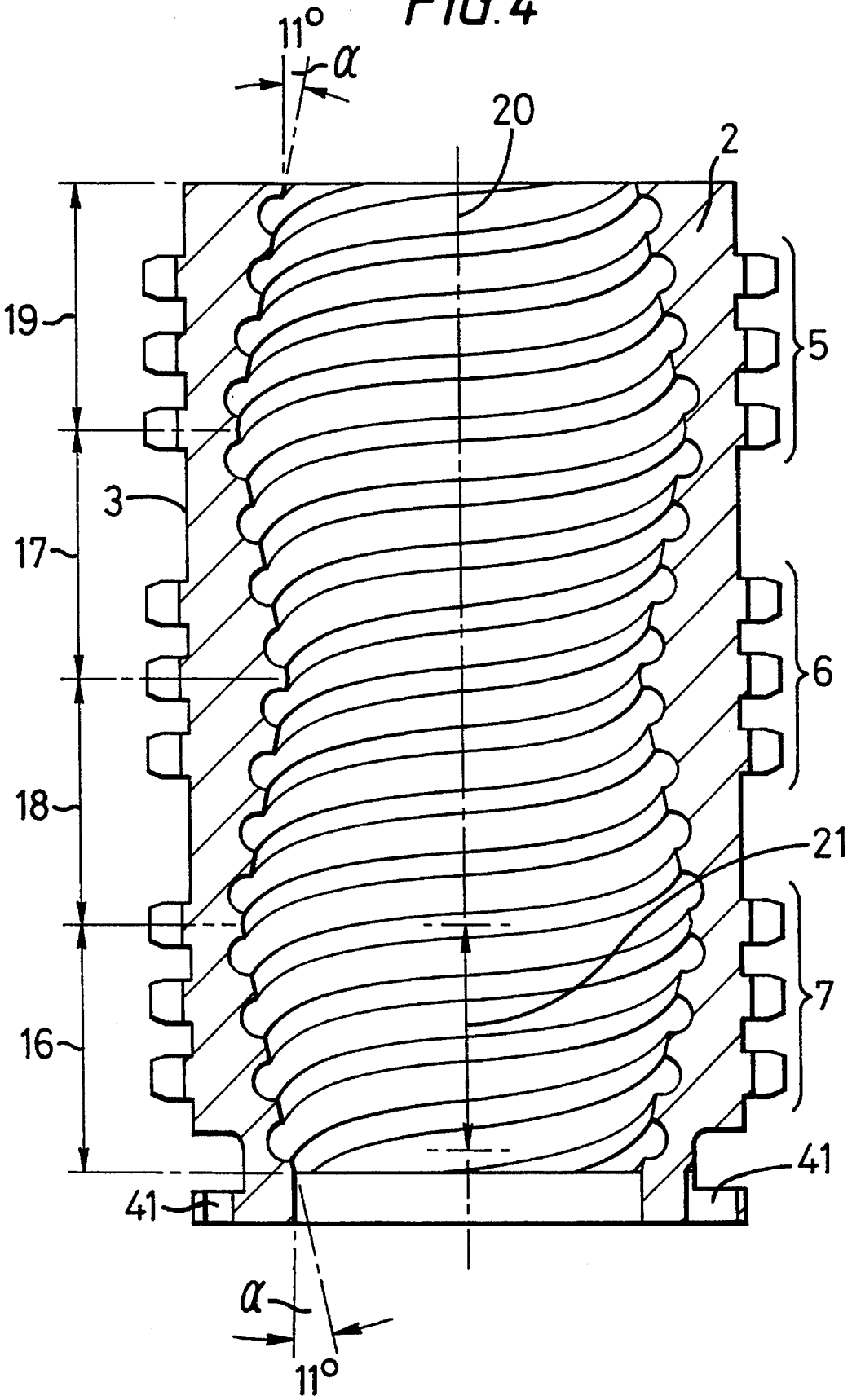
FIG. 4 shows, to an enlarged scale, a section through an outer member forming part of the apparatus shown in FIG. 1.

Referring now to FIG. 4, the inner surface of the outer member 2 is provided with four conical surfaces, viz. a first conical surface 16, a second conical surface 17, a third conical surface 18 and a fourth conical surface 19.

Each conical surface 16, 17, 18 and 19 is inclined to the longitudinal axis 20 of the outer member 2 at an angle $\alpha$ of 11°.

The inner surface of the outer member 2 is provided with a four start thread each thread having a pitch 21 of approximately 100 mm.

As shown in FIG. 3, the outer member 2 encircles four inner members, viz. a first inner member 22, a second inner member 23, a third inner member 24 and a fourth inner member 25.

Referring now to FIG. 5, the inner member 22 has an outer surface having four conical surfaces, viz. a first conical surface 26, a second conical surface 27, a third conical surface 28 and a fourth conical surface 29.

Each conical surface 26, 27, 28, 29 is inclined to the longitudinal axis 30 of the inner member 22 at an angle $\beta$ of 11° which corresponds to the angle a aforesaid.

The outer surface of the inner member 22 is provided with a plurality of cavities 31. Each cavity 31 is drilled to accommodate a ball bearing holder 32 (FIGS. 6 and 7). In use, the ball bearing holders 32 are pressed into their respective cavities and ball bearings pressed into each ball bearing holder 32. The ball bearings are retained in place by ears 33, 34 the upper surface 35 of each of which is also inclined at angle $\beta$ of 11° so that it is parallel to the relevant conical surface 26, 27, 28, 29 of the first inner member 22 in which it is fitted.

A non-marking gripping assembly is mounted on each inner member 22, 23, 24, 25. The non-marking jaw assembly 36 comprises a layer of elastomeric material in which is embedded a plurality of short metal pins, some of which extend to the pipe gripping surface 38 and enhance the grip between the elastomeric material and a pipe 39.

The non-marking jaw assembly 36 also includes a back plate 40 to which the elastomeric material 37 is secured. In certain embodiments the back plate 40 is deleted and the elastomeric material 37 is secured direct to the first inner member 22. Similar non-marking jaw assemblies are mounted on inner members 23, 24, 25.

Figure 2:
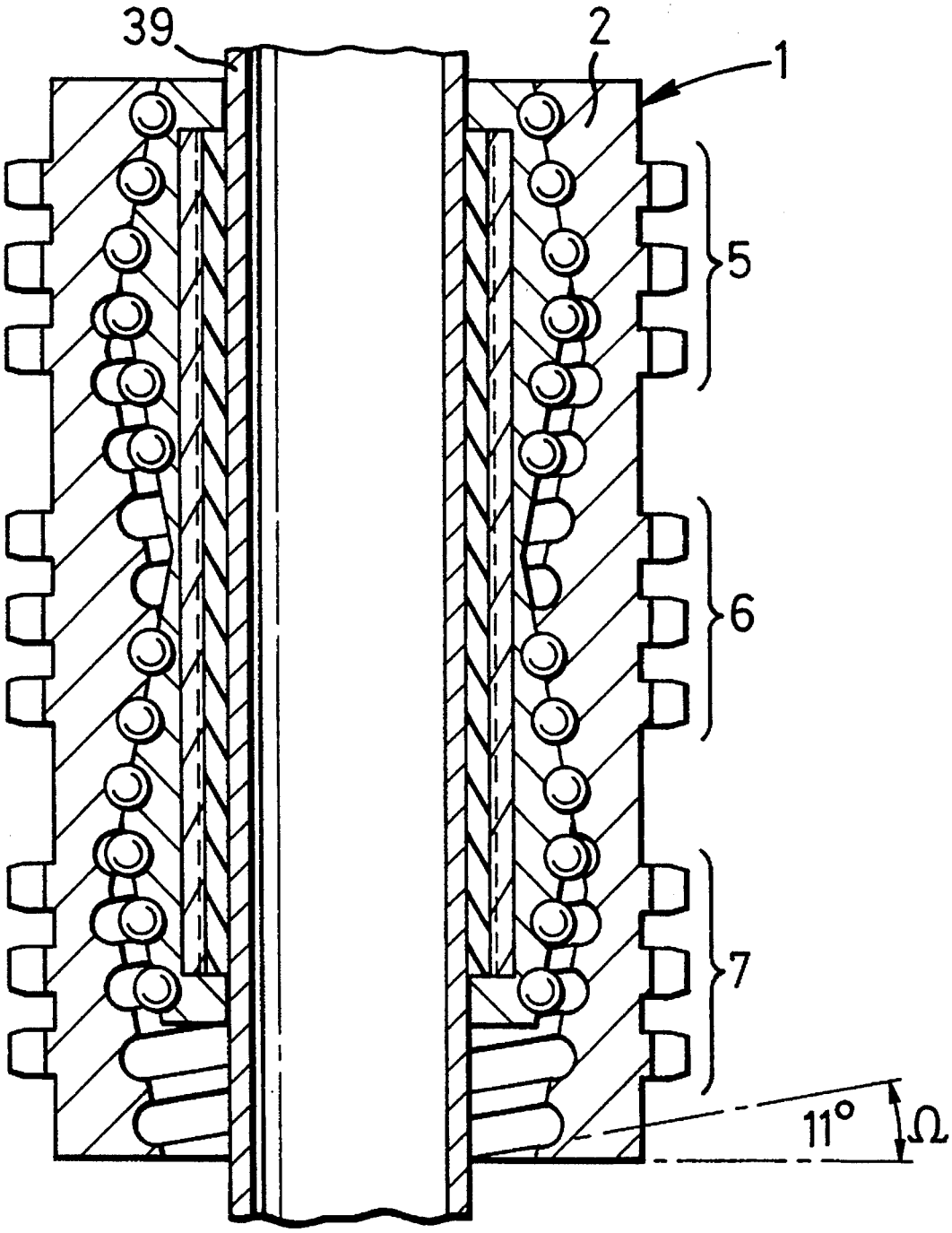
FIG. 2 is a vertical cross-section through the apparatus of FIG. 1 gripping a pipe for rotation in the opposite sense.

As can be seen from FIGS. 1 and 2, when the inner members 22, 23, 24, 25 are placed inside the outer member 2, the ball bearings are disposed in juxtaposition with the threads in the outer member 2. By rotating the outer member 2 in one sense relative to the inner members 22, 23, 24, 25 the inner members can be moved into the pipe gripping position shown in FIG. 1 whilst rotation in the opposite sense causes the inner members to move into the pipe gripping position shown in FIG. 2.

In use, one half 3 of the outer member 2 will be bolted onto the top of a rotary of a gated power tong via bolt holes 41.

As the start of a pipe gripping operation the inner members 22, 32, 24, 25 are positioned midway between the positions shown in FIGS. 1 and 2. The rod 15 is pulled outwardly to pull the end sections of the chains away from half 3 which can then be pivoted open to admit pipe 39 into the apparatus 1. During this time the gate to the rotary (not shown) will be open.

The halves 3, 4 are then closed around pipe 39 and the end sections of the chains remounted on half 3 to secure the two halves 3, 4 together. Similarly, the gate on the rotary (not shown) is closed.

When the rotary is actuated in one sense the outer member rotates clockwise when viewed from above. Normally, there will be sufficient surface contact between the non-marking jaw assemblies and the pipe 39 so that the outer member 2 will rotate relative to the inner members 22, 23, 24, 25. However, if the outer member 2 and inner members 22, 23, 24, 25 rotate together the inner members 22, 23, 24, 25 may be manually restrained for an initial period. Alternatively, the inner member 22, 23, 24, 25 may be associated with a brake, for example a spring member which acts between the pipe 39 and the inner members 22, 23, 24, 25 and inhibits relative rotation therebetween.

On commencement of relative movement between the outer member 2 and the inner members 22, 23, 24, 25 the inner members 22, 23, 24, 25 move upwardly as shown in FIG. 2. As they travel upwardly they are cammed inwardly by the co-operation of the ball bearings with the first conical portion 16 and the second conical portion 17.

When sufficient radial pressure has been applied the outer member 2, inner members 22, 23, 24, 25 and pipe 39 rotate in unison.

It is particularly important when joining premium tubulars that each joint is tightened extremely accurately and very sophisticated electronic equipment is available to ensure that the required torque is applied to each joint. It is therefore very important that after a joint has been correctly tightened it is not loosened when the jaws are released.

In the embodiment disclosed, at the end of a tightening operation the rotary is stopped and the jaws can readily be released by rotating the rotary anti-clockwise. In this connection it will be noted that the angle $\Omega$ (FIG. 2) is 11°.

When unscrewing a joint the outer member 2 is rotated anti-clockwise as viewed from above. The inner members 22, 23, 24, 25 move downwardly relative to the outer member 2 to the pipe gripping position shown in FIG. 1. Again, at the end of an uncoupling operation the pipe can readily be released from the jaws.

Whilst ball bearings are preferred other types of bearings could also be used, for example roller bearings. Similarly, whilst the non-marking gripping assembly described is recommended other gripping assemblies may also be used, for example a simple layer of elastomeric material.

What is claimed is:

1. An apparatus for gripping a pipe, which apparatus comprises an outer member having a first inclined inner surface, and an inner member having a first inclined outer surface, the arrangement being such that, in use, on rotation of said outer member relative to said inner member in one sense said first inclined inner surface co-operates with said first inclined outer surface so that said inner member moves towards a pipe to be gripped, and wherein the outer surface of the inner member is provided with at least two ball bearings and the inner surface of the outer member is provided with at east one groove for accommodating said ball bearings.

2. An apparatus as claimed in claim 1, wherein said outer member comprises a second inclined inner surface spaced from said first inclined inner surface and said inner member comprises a second inclined outer surface spaced from said first inclined outer surface.

3. An apparatus as claimed in claim 2, wherein said outer member comprises a first oppositely inclined inner surface, and said inner member comprises a first oppositely inclined outer surface, the arrangement being such that on rotation of said outer member relative to said inner member in the opposite sense said first oppositely inclined inner surface co-operates with said first oppositely inclined outer surface so that said inner member moves towards a pipe to be gripped.

4. An apparatus as claimed in claim 3, wherein said outer member comprises a second oppositely inclined inner surface, and said inner member comprises a second oppositely inclined outer surface arranged to co-operate therewith.

5. An apparatus as claimed in claim 4, wherein the inclined surfaces are inclined at an angle such that the inner member and outer member do not lock against one another.

6. An apparatus as claimed in claim 5 wherein the surfaces are inclined at an angle of at least 7° to the longitudinal axis of the pipe.

7. An apparatus as claimed in claim 6, wherein said angle is 11°.

8. An apparatus as claimed in claim 1, including at least two inner members.

9. An apparatus as claimed in claim 8, wherein said outer member has a separate groove for each said inner member.

10. An apparatus as claimed in claim 1, including four inner members, wherein said outer member has four separate grooves.

11. An apparatus as claimed in claim 1, wherein said inner member is provided with an elastomeric gripping member.

12. An apparatus as claimed in claim 9, including at least one spring to facilitate the release of said inner member after use.

13. An apparatus as claimed in claim 1, wherein said inclined surfaces are conical.

14. An apparatus for gripping a pipe, which apparatus comprises an outer member having a first inclined inner surface, and an inner member having a first inclined outer surface, the arrangement being such that, in use, on rotation of said outer member relative to said inner member in one sense said first inclined inner surface co-operates with said first inclined outer surface so that said inner member moves towards a pipe to be gripped, wherein the outer surface of-the inner member is provided with at least one ball bearing and the inner surface of the outer member is provided with at least one groove for accommodating said ball bearing.

15. An apparatus as claimed in claim 14, wherein said outer member comprises a second inclined inner surface spaced from said first inclined inner surface and said inner member comprises a second inclined outer surface spaced from said first inclined outer surface.

16. An apparatus as claimed in claim 14, wherein said outer member comprises a first oppositely inclined inner surface, and said inner member comprises a first oppositely inclined outer surface, the arrangement being such that on rotation of said outer member relative to said inner member in the opposite sense said first oppositely inclined inner surface co-operates with said first oppositely inclined outer surface so that said inner member moves towards a pipe to be gripped.

17. An apparatus as claimed in claim 16, wherein said outer member comprises a second oppositely inclined inner surface, and said inner member comprises a second oppositely inclined outer surface arranged to co-operate therewith.

18. An apparatus as claimed in claim 14, wherein the inclined surfaces are inclined at an angle such that the inner member and outer member do not lock against one another.

19. An apparatus as claimed in claim 18, wherein the surfaces are inclined at an angle of at least 7° to the longitudinal axis of the pipe.

20. An apparatus as claimed in claim 19, wherein said angle is 11°.

21. An apparatus as claimed in claim 14, including at least two inner members.

22. An apparatus as claimed in claim 21, wherein said outer member has a separate groove for each said inner member.

23. An apparatus as claimed in claim 14, wherein said inner member is provided with an elastomeric gripping member.

24. An apparatus as claimed in claim 14, wherein said inclined surfaces are conical.

25. An apparatus for gripping a pipe, which apparatus comprises an outer member having a first inclined inner surface, and four inner members each having a first inclined outer surface, the arrangement being such that, in use, on rotation of said outer member relative to said inner members in one sense said first inclined inner surface co-operates with said first inclined outer surfaces so that said inner members move towards a pipe to be gripped, wherein said outer member has four separate grooves.

26. An apparatus for gripping a pipe, which apparatus comprises an outer member having a first inclined inner surface, and an inner member having a first inclined outer surface, the arrangement being such that, in use, on rotation of said outer member relative to said inner member in one sense said first inclined inner surface co-operates with said first inclined outer surface so that said inner member moves towards a pipe to be gripped, and including at least one spring to facilitate the release of said inner member after use.

27. An apparatus for gripping a pipe, which apparatus comprises an outer member having a first inclined inner surface and a second inclined inner surface spaced from said first inclined inner surface, and an inner member having a first inclined outer surface and a second inclined outer surface spaced from said first inclined outer surface, the arrangement being such that, in use, on rotation of said outer member relative to said inner member in one sense said first inclined inner surface and said second inclined inner surface co-operate with said first inclined outer surface and said second inclined outer surface respectively so that said inner member moves towards a pipe to be gripped, and wherein said outer member comprises a first oppositely inclined inner surface, and said inner member comprises a first oppositely inclined outer surface and a second oppositely inclined outer surface, the arrangement being such that on rotation of said outer member relative to said inner member in the opposite sense said first and said second oppositely inclined inner surface co-operates with said first oppositely inclined outer surface and said second oppositely inclined outer surface respectively so that said inner member moves towards a pipe to be gripped, wherein the outer surface of the inner member is provided with at least one ball bearing and the inner surface of the outer member is provided with at least one groove for accommodating said ball bearing.

28. An apparatus as claimed in claim 27, including at least two inner members.

29. An apparatus as claimed in claim 28, wherein said outer member has a separate groove for each said inner member.

30. An apparatus as claimed in claim 29, including four inner members, wherein said outer member has four separate grooves.

31. An apparatus as claimed in claim 27, wherein said inner member is provided with an elastomeric gripping member.

32. An apparatus as claimed in claim 27, including at least one spring to facilitate the release of said inner member after use.

* * * * *